US011587525B2

(12) United States Patent
Jeon et al.

(10) Patent No.: US 11,587,525 B2
(45) Date of Patent: Feb. 21, 2023

(54) TUNING METHOD AND APPARATUS FOR COLOR GAMUT MAPPING DEVICE

(71) Applicant: LX SEMICON CO., LTD., Daejeon (KR)

(72) Inventors: Hyun Kyu Jeon, Daejeon (KR); Ji Won Lee, Daejeon (KR); Ji Min Lee, Daejeon (KR); Ji Hong Yuk, Daejeon (KR); Chang Young Bae, Daejeon (KR); Seul Gi Lee, Daejeon (KR)

(73) Assignee: LX SEMICON CO., LTD., Daejeon (KR)

( * ) Notice: Subject to any disclaimer, the term of this patent is extended or adjusted under 35 U.S.C. 154(b) by 0 days.

(21) Appl. No.: 17/528,406

(22) Filed: Nov. 17, 2021

(65) Prior Publication Data

US 2022/0165233 A1 May 26, 2022

(30) Foreign Application Priority Data

Nov. 23, 2020 (KR) ..... 10-2020-0157634

(51) Int. Cl.
*G09G 5/02* (2006.01)
*G09G 5/06* (2006.01)
(Continued)

(52) U.S. Cl.
CPC ..... *G09G 5/026* (2013.01); *G09G 3/2003* (2013.01); *G09G 5/06* (2013.01); *G09G 2320/0666* (2013.01); *G09G 2340/06* (2013.01)

(58) Field of Classification Search
CPC ..... G09G 5/02; G09G 5/06; G09G 5/026; G09G 3/2003; G09G 2320/06;
(Continued)

(56) References Cited

U.S. PATENT DOCUMENTS

2006/0244983 A1* 11/2006 Zeng ..... H04N 1/6058 358/1.9
2010/0020106 A1* 1/2010 Gil ..... G09G 5/02 345/690
(Continued)

FOREIGN PATENT DOCUMENTS

CN 101312487 A * 11/2008 ..... H04N 1/6058
CN 112671998 A * 4/2021 ..... H04N 1/6075
(Continued)

*Primary Examiner* — Wesner Sajous
(74) *Attorney, Agent, or Firm* — Harness, Dickey & Pierce, P.L.C.

(57) ABSTRACT

The present disclosure relates to a tuning method and apparatus for a color gamut mapping device, in which a tuning time is shortened by automatically setting and changing parameters of a register when tuning the color gamut mapping device. A tuning method of a color gamut mapping device according to an aspect includes an initial setting operation of setting, by a test device, initial parameters in a register of a color gamut mapping device, a measuring operation of measuring, by a measuring device, chromaticity for each of a plurality of color images which are supplied from the test device and displayed on a panel of a display device through the color gamut mapping device, an automatic tuning operation of changing, by the test device, saturation parameters and hue parameters of a plurality of hue axes of the color gamut mapping device by using a result measured from the measuring device.

17 Claims, 8 Drawing Sheets

(51) Int. Cl.

| | |
|---|---|
| ***G09G 3/20*** | (2006.01) |
| ***H04N 1/60*** | (2006.01) |
| ***H04N 5/57*** | (2006.01) |
| ***H04N 5/202*** | (2006.01) |
| ***H04N 9/64*** | (2006.01) |
| ***H04N 9/67*** | (2006.01) |
| ***H04N 9/69*** | (2006.01) |
| ***H04N 9/77*** | (2006.01) |

(58) Field of Classification Search

CPC ..... G09G 2320/0666; G09G 2340/06; G09G 2320/0276; G09G 2320/0273; G09G 2320/626; G06F 17/10; G06F 7/144; H04N 1/60; H04N 1/6052; H04N 1/6058; H04N 1/6066; H04N 1/6005; H04N 1/6075; H04N 9/64; H04N 9/67; H04N 9/69; H04N 9/77; H04N 5/57; H04N 5/202; H04N 9/643; H04N 9/646

USPC ..... 345/590

See application file for complete search history.

(56) References Cited

U.S. PATENT DOCUMENTS

| | | | | |
|---|---|---|---|---|
| 2013/0286040 | A1 | 10/2013 | Kawaguchi | |
| 2014/0126004 | A1* | 5/2014 | Miyahara ..... | H04N 1/6061 358/1.9 |
| 2022/0165232 | A1* | 5/2022 | Jeon ..... | H04N 1/6058 |

FOREIGN PATENT DOCUMENTS

| | | | |
|---|---|---|---|
| KR | 10-0552695 | B1 | 2/2006 |
| KR | 10-1065406 | B1 | 9/2011 |

* cited by examiner

TUNING METHOD AND APPARATUS FOR COLOR GAMUT MAPPING DEVICE

CROSS-REFERENCE TO RELATED APPLICATIONS

This application claims the benefit of the Korean Patent Application No. 10-2020-0157634 filed on Nov. 23, 2020, which are hereby incorporated by reference as if fully set forth herein.

FIELD

The present disclosure relates to a tuning method and apparatus for a color gamut mapping device which are capable of shortening a tuning time by automatically setting and changing parameters of a register when tuning the color gamut mapping device.

BACKGROUND

As display devices are being developed toward higher resolution and higher definition, color reproducibility thereof is improving.

Since a color reproduction area that can be expressed by a display device, that is, a color gamut, varies depending on the characteristics of the display device, a color gamut mapping process for compressing or extending a color gamut of an input image according to the characteristics of the display device is required.

In order to control saturation and hue, color gamut mapping devices use a plurality of saturation-related parameters and a plurality of hue-related parameters set in registers. To this end, the color gamut mapping device requires a tuning process in which a plurality of parameters suitable for a target color gamut are set and stored in a plurality of registers.

However, conventionally, when tuning a color gamut mapping device, an operator should directly and manually change a plurality of parameters stored in registers, and thus there is a problem in that it takes a long time for tuning a color gamut.

SUMMARY

The present disclosure is directed to providing a tuning method and apparatus for a color gamut mapping device which are capable of shortening a tuning time by automatically setting and changing parameters of a register when tuning the color gamut mapping device.

One aspect of the present disclosure provides a tuning method of a color gamut mapping device, which includes an initial setting operation of setting, by a test device, initial parameters in a register of a color gamut mapping device, a measuring operation of measuring, by a measuring device, chromaticity for each of a plurality of color images which are supplied from the test device and displayed on a panel of a display device through the color gamut mapping device, an automatic tuning operation of changing, by the test device, saturation parameters and hue parameters of a plurality of hue axes of the color gamut mapping device by using a result measured from the measuring device and the initial parameters on the basis of a difference between a uv measurement value of each of the plurality of color images and a uv reference value of each of the plurality of color images, and an updating operation of transmitting, by the test device, the changed saturation parameters and hue parameters of the respective hue axes to the color gamut mapping device and updating the register.

Another aspect of the present disclosure provides a tuning apparatus for a color gamut mapping device, which includes a test device, a display device configured to display a plurality of color images which are supplied from the test device through a color gamut mapping device on a panel, and a measuring device configured to measure chromaticity for each of the plurality of color images displayed on the panel. The test device sets initial parameters in a register of the color gamut mapping device, performs an automatic tuning process in which saturation parameters set for each of a plurality of saturation control areas to correspond to a plurality of hue axes and hue parameters set for each of a plurality of hue control areas to correspond to the respective hue axes are changed based on differences between uv measurement values of the plurality of color images supplied from the measuring device and uv reference values set to correspond to target color points of the plurality of color images, and transmits the changed saturation parameters and hue parameters for each hue axis to the color gamut mapping device to update the register.

The test device may repeat the measuring process of supplying the plurality of color images to the display device and receiving the uv measurement values of the plurality of color images displayed on the panel from the measuring device, the automatic tuning process of changing the saturation parameters and the hue parameters, and the process of updating the register, until a representative error value using errors between the uv reference values and the uv measurement values is less than or equal to a threshold value.

When the representative error value is less than or equal to the threshold value, the test device may complete the automatic tuning process.

When the representative error value exceeds the threshold value, the test device may perform default setting for performing the automatic tuning, divide a plurality of saturation control areas on the basis of the plurality of uv measurement values and the plurality of uv reference values and change the saturation parameters for each saturation control area, and divide a plurality of hue control areas on the basis of the plurality of uv measurement values and the plurality of uv reference values and change the hue parameters for each hue control area.

The test device may determine three-color data of each of a plurality of color points on the basis of the plurality of uv measurement values to perform degamma thereon, convert the three-color data of each color point on which the degamma is performed into a luminance component and a pair of chrominance components, and calculate a first saturation boundary value that distinguishes a first saturation control area and a second saturation control area using first and second saturation control points and a maximum saturation value which are preset, a second saturation boundary value that distinguishes the second saturation control area and a third saturation control area, and a third saturation boundary value that distinguishes the first saturation control area and the second hue control area using a hue control point and the maximum saturation value.

The test device may determine a saturation control area in which each color point is located by comparing a saturation value using the chrominance components of each color point with the first and second saturation boundary values, determine a direction of change of the saturation parameters for each determined saturation control area on the basis of a distance difference between a reference distance component using the uv reference value and a measurement distance component using the uv measurement value, and change the saturation parameters step by step by applying a step-by-step change value according to the determined direction of change to each saturation parameters.

The test device may calculate reference distances between the respective uv reference values and an intermediate point and measurement distances between the respective uv measurement values and the intermediate point, calculate distance differences between the calculated reference distances and the calculated measurement distances and average the distance differences for each saturation control area to calculate as an error average, determine the direction of change of the saturation parameter as a decreasing direction or an increasing direction according to the error average calculated for each saturation control area, and add the step-by-step change value according to the determined decreasing or increasing direction of the saturation parameter to the respective saturation parameters.

The test device may determine a hue control area in which each color point is located by comparing a saturation value using the chrominance components of each color point with the third saturation boundary value, determine a direction of change of the hue parameters for each determined hue control area on the basis of an angle difference between a reference angle of the uv reference value and a measurement angle of the uv measurement value, and change the hue parameters by applying a step-by-step change value according to the determined direction of change.

The test device may calculate an angle difference between the reference angle with respect to a slope of a straight line connecting the uv reference value to a white point and the measurement angle with respect to a slope of a straight line connecting the uv measurement value to the white point, determine the direction of change of the hue parameters as a decreasing direction or an increasing direction according to the angle difference calculated for each hue control area, and add the step-by-step change value according to the determined decreasing or increasing direction of the hue parameter to the respective hue parameters.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION

Figure 1:
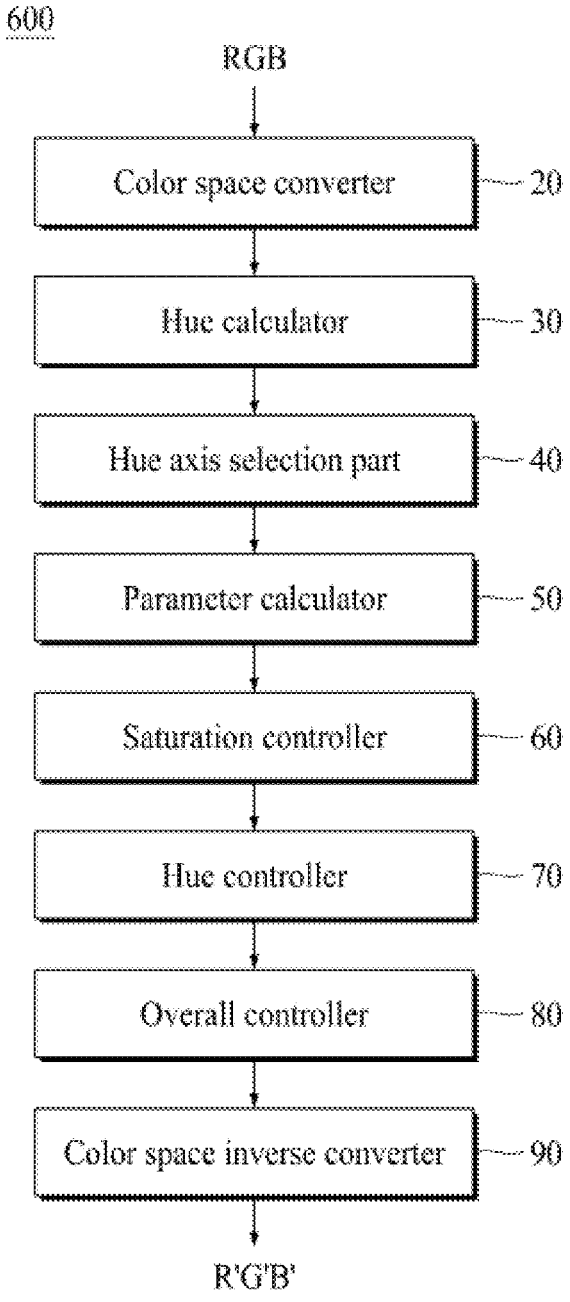
FIG. 1 is a block diagram illustrating a color gamut mapping device according to an embodiment.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout the specification. In the following description, when the detailed description of the relevant known function or configuration is determined to unnecessarily obscure the important point of the present disclosure, the detailed description will be omitted.

In a case where 'comprise', 'have', and 'include' described in the present specification are used, another part may be added unless 'only~' is used. The terms of a singular form may include plural forms unless referred to the contrary.

In construing an element, the element is construed as including an error range although there is no explicit description.

In describing a position relationship, for example, when a position relation between two parts is described as "on," "over," "under," and "next," one or more other parts may be disposed between the two parts unless a more limiting term, such as "just" or "direct(ly)" is used.

In describing a time relationship, for example, when the temporal order is described as, for example, "after," "subsequent," "next," and "before," a case which is not continuous may be included unless a more limiting term, such as "just," "immediate(ly)," or "direct(ly)" is used.

It will be understood that, although the terms "first," "second," etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

In describing the elements of the present disclosure, the terms "first," "second," "A," "B," "(a)," "(b)," etc., may be used. These terms are intended to identify the corresponding elements from the other elements, and basis, order, or number of the corresponding elements should not be limited by these terms. The expression that an element is "connected," "coupled," or "adhered" to another element or layer, the element or layer can not only be directly connected or adhered to another element or layer, but also be indirectly connected or adhered to another element or layer with one or more intervening elements or layers "disposed" between the elements or layers, unless otherwise specified.

The term "at least one" should be understood as including any and all combinations of one or more among the associated listed elements. For example, the meaning of "at least one or more of a first element, a second element, and a third element" denotes the combination of all elements proposed from two or more of the first element, the second element, and the third element as well as the first element, the second element, or the third element.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

As used herein, the term "part" refers to software or a hardware component such as a field-programmable gate array (FPGA) or an application-specific integrated circuit (ASIC), and the "part" performs certain functions. However, the "part" is not limited to software or hardware. The "part" may be configured to be stored in a storage medium that may be addressed or may be configured to be executed by one or more processors. Therefore, the "part" includes, for example, software components, processes, functions, drivers, firmware, circuits, data, database, and tables.

Hereinafter, exemplary embodiments of the present disclosure will be described in detail with reference to the accompanying drawings.

Before describing a tuning method and apparatus for a color gamut mapping device according to an embodiment, components of the color gamut mapping device according to the embodiment and a plurality of parameters stored in registers of the color gamut mapping device according to the embodiment will be first described.

Figure 2:
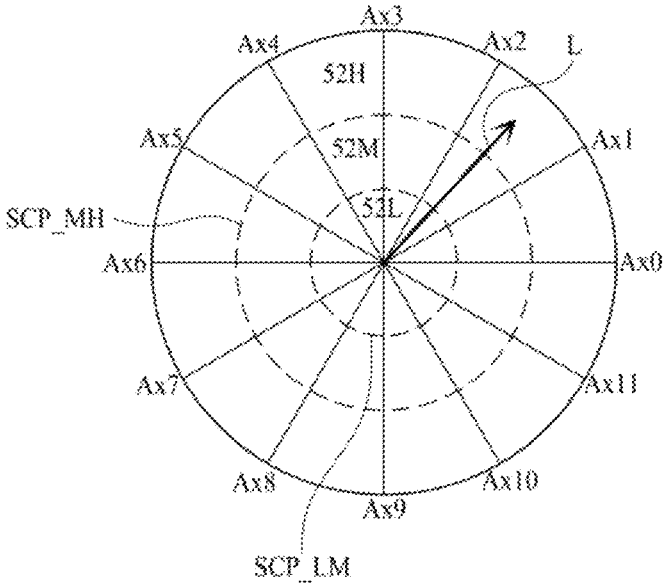
FIG. 2 is a diagram illustrating hue axes and saturation control areas in a circular color area according to an embodiment.
Figure 3:
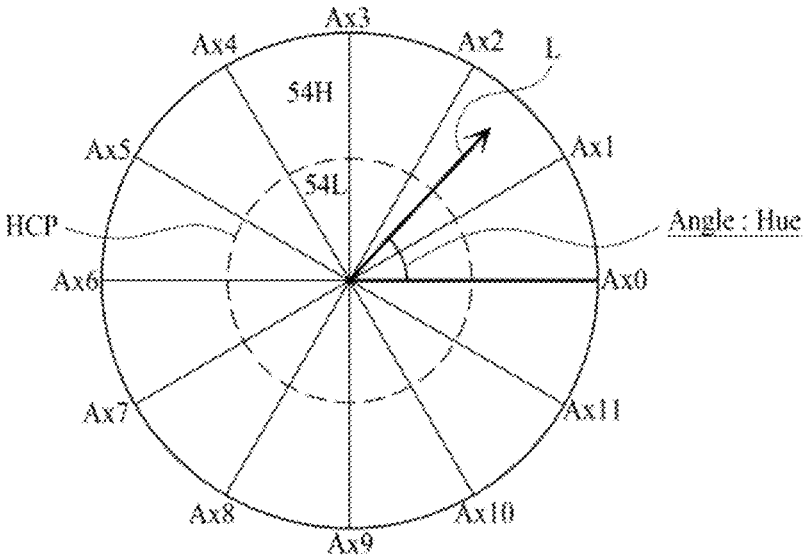
FIG. 3 is a diagram illustrating hue control areas in a circular color area according to an embodiment.

FIG. 1 is a block diagram illustrating a color gamut mapping device according to an embodiment, FIG. 2 is a diagram illustrating hue axes and saturation control areas in a circular color area according to the embodiment, and FIG. 3 is a diagram illustrating hue control areas in the circular color area according to the embodiment.

A color gamut mapping device 600 illustrated in FIG. 1 may include a color space converter 20, a hue calculator 30, a hue axis selection part 40, a parameter calculator 50, a saturation controller 60, a hue controller 70, an overall controller 80, and a color space inverse converter 90. Here, the overall controller 80 may be omitted.

The color space converter 20 receives red (R), green (G), blue (B) input signals (hereinafter, R, G, and B signals) of an input image and converts the R, G, and B signals into Y, Cb, and Cr signals respectively representing a luminance component Y, a chrominance component Cb, and a chrominance component Cr by using an RGB-to-YCbCr conversion function.

The hue calculator 30 calculates a hue angle representing a hue value of the corresponding chrominance signals Cb and Cr using the chrominance signals Cb and Cr among the input signals Y, Cb, and Cr supplied from the color space converter 20.

The hue axis selection part 40 selects hue axes of a control area in which the hue angle calculated by the hue calculator 30 is located. Referring to FIG. 2, a circular color area on a Cb-Cr plane may be divided into twelve control areas by twelve hue axes Ax0 to Ax11 having intervals of 30 degrees. The hue axis selection part 40 selects first and second hue axes in an area in which the supplied hue angle is located from among the twelve hue axes Ax0 to Ax11.

The parameter calculator 50 calculates a plurality of parameters, that is, saturation gains and hue gains, using the parameters that are set to correspond to the two hue axes selected by the hue axis selection part 40 and using the hue angle supplied from the hue axis selection part 40.

Referring to FIGS. 2 and 3, each of the control areas divided by the hue axes Ax0 to Ax11 may be divided into first to third saturation control areas 52L, 52M, and 52H by first and second saturation control points SCP_LM and SCP_MH having different saturation values corresponding to a length of a straight line L from the origin, and may be further divided into first and second hue control areas 54L and 54H by a saturation value of a hue control point HCP.

The first saturation control point SCP_LM refers to a first saturation boundary value that distinguishes the first saturation control area 52L, which is a lower saturation area, from the second saturation control area 52M, which is an intermediate saturation area. The second saturation control point SCP_MH refers to a second saturation boundary value that distinguishes the second saturation control area 52M from the third saturation control area 52H, which is an upper saturation area. The hue control point HCP refers to a saturation boundary value that distinguishes the first hue control area 54L for hue control in the lower saturation area from the second hue control area 54H for hue control in the upper saturation area. The first saturation control point SCP_LM, the second saturation control point SCP_MH, and the hue control point HCP are set values stored in registers.

The parameters, which are each set to correspond to one hue axis and are stored in registers, include a first saturation gain corresponding to the first saturation control area 52L, a second saturation gain corresponding to the second saturation control area 52M, a third saturation gain corresponding to the third saturation control area 52H, a first hue gain corresponding to the first hue control area 54L, and a second hue gain corresponding to the second hue control area 54H.

The parameter calculator 50 may linearly interpolate a first hue axis parameter Parameter_axis(n−1) and a second hue axis parameter Parameter_axis(n) as shown in Equation 1 below using an angle difference d(n−1) between a supplied hue angle Target and a first hue axis Ax(n−1) and an angle difference d(n) between a second hue axis Ax(n) and the supplied hue angle Target to calculate a saturation gain or hue gain to be applied to the linearly interpolated parameter Parameter_result, that is, the corresponding Cb and Cr signals.

$$\text{Parameter_result}=d(n-1)\times\text{Parameter_axis}(n)+d(n)\times\text{Parameter_axis}(n-1) \quad \text{[Equation 1]}$$

The parameter calculator 50 may linearly interpolate first to third saturation parameters, which are set to the first to third saturation control areas 52L, 52M, and 52H of the selected first hue axis, and first to third saturation parameters, which are set to the first to third saturation control areas 52L, 52M, and 52H of the selected second hue axis, for each saturation control area using the supplied hue angle as shown in Equation 1 above to calculate the first to third saturation gains corresponding to the first to third saturation control areas 52L, 52M, and 52H.

The parameter calculator 50 may linearly interpolate first and second hue parameters, which are set to the first and second hue control areas 54L and 54H of the selected first hue axis, and first and second hue parameters, which are set to the first and second hue control areas 54L and 54H of the selected second hue axis, for each hue control area using the supplied hue angle as shown in Equation 1 above to calculate the first and second hue gains corresponding to the first and second hue control areas 54L and 54H.

The saturation controller 60 determines a saturation control area in which the chrominance signals Cb and Cr supplied from the parameter calculator 50 are located and controls the saturation of the supplied chrominance signals Cb and Cr by applying the corresponding saturation gain for each saturation control area according to the determined saturation control area. The saturation controller 60 may compare the saturation values of the chrominance signals Cb and Cr with the first and second saturation control points SCP_LM and SCP_MH and divide the saturation values for each saturation control area and may precisely control the saturation of the supplied chrominance signals Cb and Cr for each saturation control area by summing values obtained by applying the saturation gain of the corresponding saturation control area to the divided saturation values.

For example, when the saturation values of the chrominance signals Cb and Cr are located in the third saturation control area 52H exceeding the second saturation control point SCP_MH, the saturation values of the chrominance signals Cb and Cr are divided into the first to third saturation values corresponding to the first to third saturation control areas 52L, 52M, and 52H and the saturation of the supplied chrominance signals Cb and Cr may be controlled for each saturation control area by summing values obtained by applying the first to third saturation gains to the divided first to third saturation values.

The hue controller 70 may compare the saturation values supplied from the saturation controller 60 with the hue control point HCP to determine the hue control area and may precisely control the hue of the Cb and Cr signals supplied from the saturation controller 60 for each hue control area by applying any one of the first and second hue gains according to the determined hue control area. The hue controller 70 may output the Cb and Cr signals whose hue is controlled by rotating the supplied Cb and Cr signals by the hue gain selected according to the saturation value.

The overall controller 80 may additionally control the saturation and hue of the input signals Y, Cb, and Cr supplied from the hue controller 70 without dividing the control area. To this end, overall saturation gains for entirely controlling the saturation of all the control areas and overall hue gains for entirely controlling the hue of all the control areas may be set and stored in the registers. The overall controller 80 may further entirely control the saturation by applying (multiplying) the overall saturation gains to (and) the Cb and Cr signals supplied from the hue controller 70. The overall controller 80 may further entirely control the hue by applying the overall hue gains to the Cb and Cr signals whose saturation is controlled by applying the overall saturation gains.

The color space inverse converter 90 may inversely convert the Y, Cb and Cr signals supplied from the overall controller 80 or the hue controller 70, that is, the Y, Cb and Cr signals whose saturation and hue are controlled, into R', G', and B' signals by using a YCbCr-to-RGB conversion function and may output the inversely converted R', G', B' signals.

As described above, the color gamut mapping device 600 according to the embodiment may control the saturation and hue of the input image for each control area divided according to the hue axis and the saturation value to output the image mapped to a target color gamut of the corresponding display device.

In the color gamut mapping device 600 according to the embodiment, a color gamut tuning process, in which saturation-related parameters assigned to the respective saturation control areas to correspond to the plurality of hue axes and hue-related parameters assigned to the respective hue control areas to correspond to the hue axes are set according to the target color gamut and the set saturation-related parameters and hue-related parameters are stored in the registers, is required.

To this end, the tuning method and apparatus for the color gamut mapping device according to the embodiment may provide an automatic tuning tool for changing the saturation-related parameters and the hue-related parameters on the basis of measurement values of chromaticity coordinates (u, v) for each of a plurality of color images, and thus a tuning time may be shortened.

Hereinafter, a tuning method and apparatus for a color gamut mapping device 600 according to an embodiment will be described.

Figure 4:
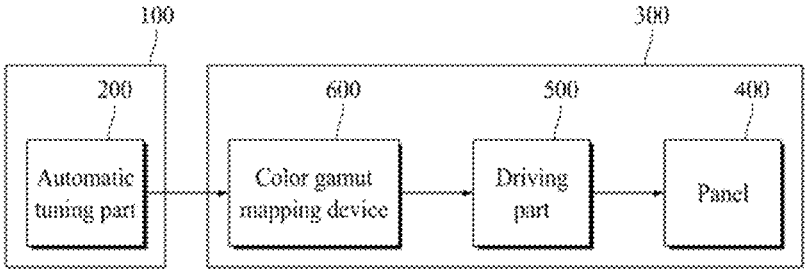
FIG. 4 is a block diagram illustrating a tuning apparatus for a color gamut mapping device according to an embodiment.
Figure 5:
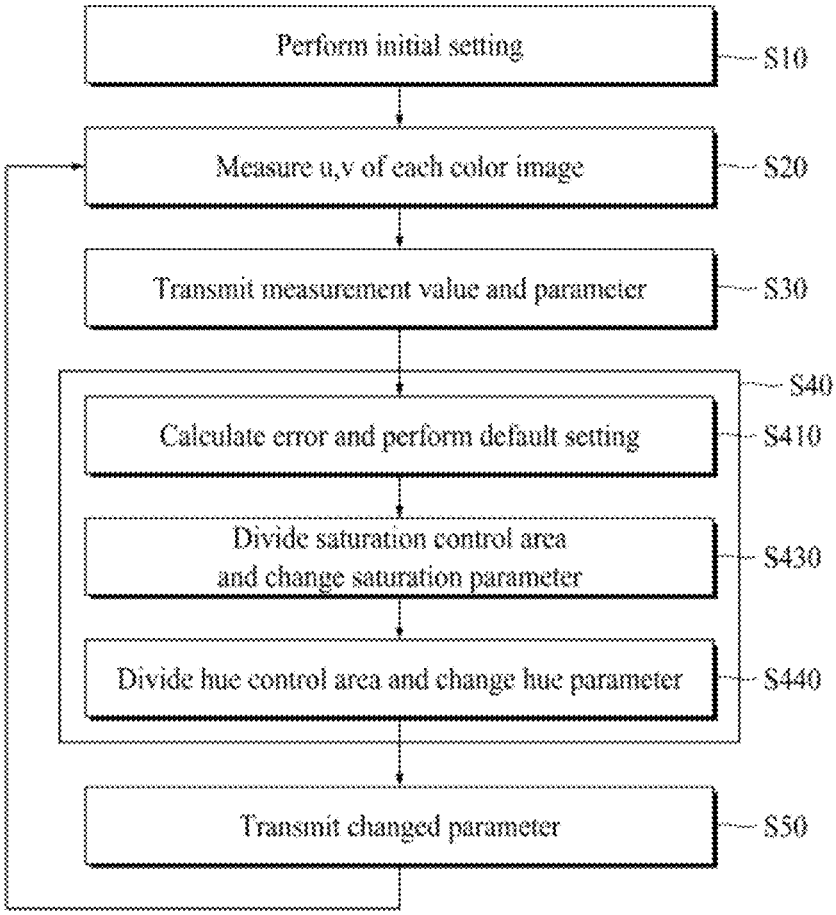
FIG. 5 is a flowchart illustrating a tuning method of a color gamut mapping device according to an embodiment.

FIG. 4 is a schematic block diagram illustrating a tuning apparatus for a color gamut mapping device according to an embodiment, and FIG. 5 is a flowchart illustrating a tuning method of the color gamut mapping device according to an embodiment.

Referring to FIG. 4, the tuning apparatus for the color gamut mapping device according to the embodiment may include a display device 300, which includes a color gamut mapping device 600, a driving part 500, and a panel 400, and a test device 100 which includes an automatic tuning part 200.

Referring to FIG. 5, the tuning method of the color gamut mapping device according to the embodiment may include an initial setting operation S10, a measuring operation S20 of u and v of each of a plurality of color images, a measurement value and parameter transmission operation S30, an automatic tuning operation S40, and a changed parameter transmission operation S50. In the tuning method of the color gamut mapping device according to the embodiment, the operations S20 to S50 may be repeated until an error between a reference value and a measurement value is less than or equal to a threshold value in the automatic tuning operation S40.

In the initial setting operation S10, the test device 100 may set a plurality of measurement-related initial values necessary for a tuning process of the color gamut mapping device 600 and register-related initial parameters of the color gamut mapping device 600.

The test device 100 may set reference u and v coordinates (hereinafter, uv reference values) of N target colors located on a plurality of hue axes and a white point in a target color gamut of the display device 300.

Figure 6:
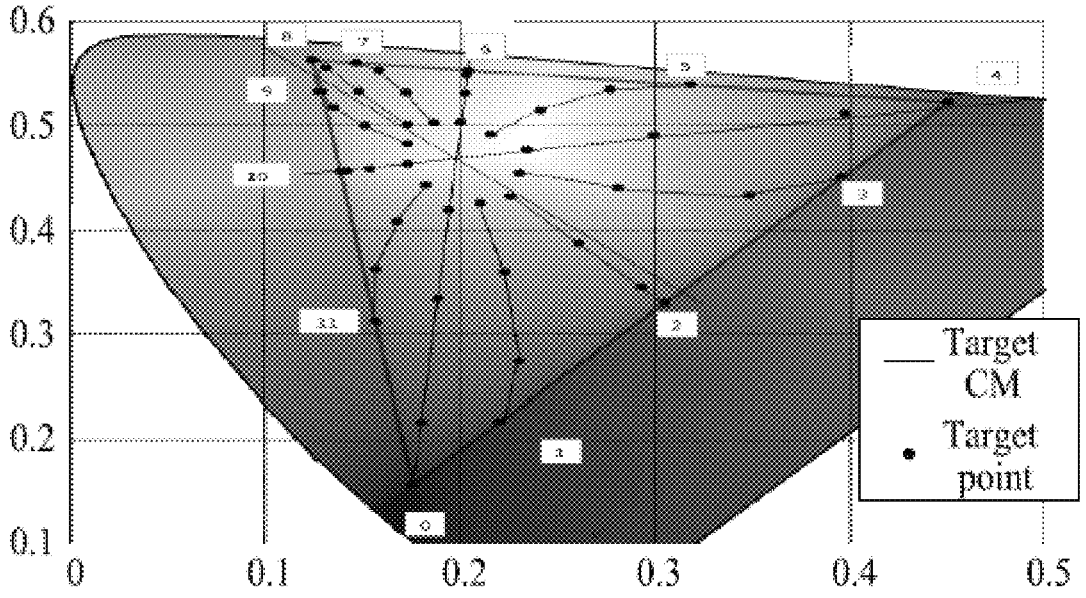
FIG. 6 is a diagram illustrating a target color gamut of a display device according to an embodiment on a uv plane.

For example, the test device 100 may set uv reference values of 48 target colors and one pair of white point coordinates corresponding to the 48 target color points located on twelve hue axes Ax0 to Ax11 in the target color gamut of the display device 300 on a uv coordinate plane of the International Commission on Illumination (CIE) illustrated in FIG. 6. In FIG. 6, four target color points may be located on each hue axis.

Further, the test device 100 may set a plurality of initial parameters and store the plurality of initial parameters in a register of the color gamut mapping device 600.

For example, the test device 100 may set 63 initial parameters including the first saturation control point SCP_LM, the second saturation control point SCP_MH, the hue control point HCP, the first saturation parameter of the first saturation control area 52L assigned to each of the twelve hue axes Ax0 to Ax11, the second saturation parameter of the second saturation control area 52M assigned to each of the twelve hue axes Ax0 to Ax11, the third saturation parameter of the third saturation control area 52H assigned to each of the twelve hue axes Ax0 to Ax11, the first hue parameter of the first hue control area 54L assigned to each of the twelve hue axes Ax0 to Ax11, and the second hue parameter of the second hue control area 54H assigned to each of the twelve hue axes Ax0 to Ax11, which are illustrated above in FIGS. 2 and 3, and may store the 63 initial parameters in the register of the color gamut mapping device 600. Further, the test device 100 may further set overall saturation gains and overall hue gains of the color gamut mapping device 600 and may store the overall saturation gains and the overall hue gains in the register of the color gamut mapping device 600.

In the measuring operation S20, the test device 100 may generate N color images corresponding to uv reference values of the N target colors and a white image corresponding to one white point and may sequentially supply the generated N color images and the generated white image to the display device 300. The display device 300 may display the sequentially supplied (N+1) images on the panel 400 through the color gamut mapping device 600 having the initial parameters and through the driving part 500. The test device 100 may measure uv coordinate values for each of the (N+1) output images displayed on the panel 400 using a luminance/chromaticity measuring device (not illustrated).

For example, the test device 100 may generate 48 color images corresponding to 48 uv reference values and one white image to sequentially supply the 48 color images and one white image to the display device 300 and may receive 49 measurement u and v coordinate values (hereinafter, uv measurement values) from the measuring device for measuring chromaticity (u,v) for each of the 49 output images sequentially displayed on the panel 400 through the color gamut mapping device 600 and the driving part 500 of the display device 300.

In the transmission operation S30, the test device 100 may transmit the (N+1) uv measurement values which are supplied from the measuring device and the plurality of parameters which are set in the initial setting operation S10 to the automatic tuning operation S40 of the automatic tuning part 200.

For example, the test device 100 may transmit the 49 uv measurement values and the 63 parameters stored in the register of the color gamut mapping device 600 to the automatic tuning operation S40 of the automatic tuning part 200. In addition, the test device 100 may transmit a plurality of option values including a threshold value, a tuning enable signal, and the like to the automatic tuning operation S40 of the automatic tuning part 200.

The automatic tuning operation S40 of the automatic tuning part 200 includes an error calculation and default setting operation S410, a saturation control area division and saturation parameter changing operation S430, and a hue control area division and hue parameter changing operation S440.

In the error calculation and default setting operation S410, the automatic tuning part 200 may calculate an error value by comparing each of the N uv measurement values with a corresponding uv reference value and determine whether automatic tuning is to be performed according to a result of comparing the calculated error value with the threshold value. When it is determined that the automatic tuning is to be performed, the automatic tuning part 200 may perform default settings for automatic tuning.

Figure 7:
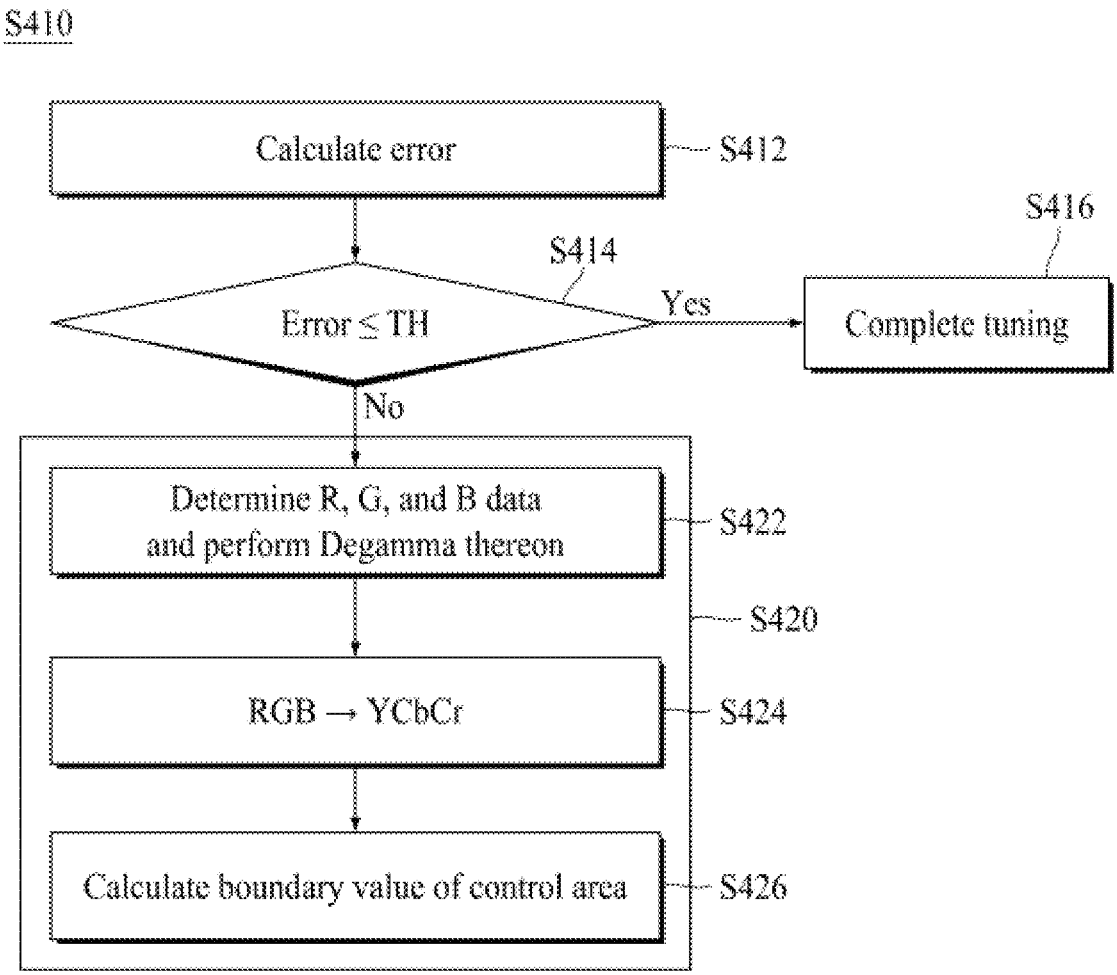
FIG. 7 is a flowchart illustrating an error calculation and default setting operation according to an embodiment.

Referring to FIG. 7, the error calculation and default setting operation S410 of the automatic tuning part 200 may include an error calculation operation S412, an error determination operation S414, an RGB data determination and degamma operation S422, a color space conversion operation S424, and a boundary value calculation operation S426 of each control area.

For example, in the error calculation operation S412, the automatic tuning part 200 may calculate an error value between each of the 48 uv measurement values excluding the measured white point value and each of the 48 uv reference values as shown in Equation 2 below.

$$\text{error}=\sqrt{(\text{ref}_y-\text{measure}_y)^2+(\text{ref}_x-\text{measure}_x)^2} \quad \text{[Equation 2]}$$

In Equation 2 above, error denotes the error value, $\text{ref}_y$ denotes a v reference value, $\text{measure}_y$ denotes a measured v value, $\text{ref}_x$ denotes a u reference value, and $\text{measure}_x$ denotes a measured u value.

The automatic tuning part 200 may calculate 48 error values corresponding to differences between the respective 48 uv measurement values and the respective 48 uv reference values and may calculate a representative error value including at least one of a maximum error value, a minimum error value, and an average error value using the calculated 48 error values.

In the error determination operation S414, the automatic tuning part 200 may compare the calculated representative error value with the threshold value, and when the calculated representative error value is less than or equal to the threshold value (Yes), the automatic tuning part 200 may complete the automatic tuning (S416).

In the error determination operation S414, when the calculated representative error value exceeds the threshold value (No), the automatic tuning part 200 proceeds to a default setting operation S420 needed to perform automatic tuning.

The default setting operation S420 of the automatic tuning part 200 may include the RGB data determination and degamma operation S422, the color space conversion operation S424, and the boundary value calculation operation S426 of each control area.

In the RGB data determination and degamma operation S422, the automatic tuning part 200 may determine R, G, and B data of each of the 48 color points from the 48 uv measurement values and perform degamma on the R, G, and B data.

In the color space conversion operation S424, the automatic tuning part 200 converts the R, G, and B data of the 48 color points on which the degamma is performed into pieces of Y, Cb, and Cr data, which are the luminance component Y and the chrominance components Cb and Cr, by using an RGB-to-YCbCr conversion function.

In the boundary value calculation operation S426 of each control area, the automatic tuning part 200 may calculate a first saturation boundary value that distinguishes the first saturation control area 52L (see FIG. 2) from the second saturation control area 52M (see FIG. 2), a second saturation boundary value that distinguishes the second saturation control area 52M (see FIG. 2) from the third saturation control area 52H (see FIG. 2), and a third saturation boundary value Hue_point that distinguishes the first hue control area 54L (see FIG. 3) from the second hue control area 54H (see FIG. 3) by using the maximum saturation value, the first and second saturation control points SCP_LM and SCP_MH, and the hue control point HCP.

For example, the automatic tuning part 200 may calculate a first saturation boundary value (Sat_low_point=Saturation_max*SCP_LM) between the first saturation control area 52L (see FIG. 2) and the second saturation control area 52M (see FIG. 2) by multiplying a maximum saturation value (Saturation_max) and the first saturation control point SCP_LM of the target color gamut. The automatic tuning part 200 may calculate a second saturation boundary value (Sat_mid_point=Saturation_max*SCP_MH) between the second saturation control area 52M (see FIG. 2) and the third saturation control area 52H (see FIG. 2) by multiplying the maximum saturation value (Saturation_max) and the second saturation control point SCP_MH. The automatic tuning part 200 may calculate a third saturation boundary value (Hue_point=Saturation_max*HCP) between the first hue control area 54L (see FIG. 3) and the second hue control area 54H (see FIG. 3) by multiplying the maximum saturation value (Saturation_max) and the hue control point HCP.

Figure 8:
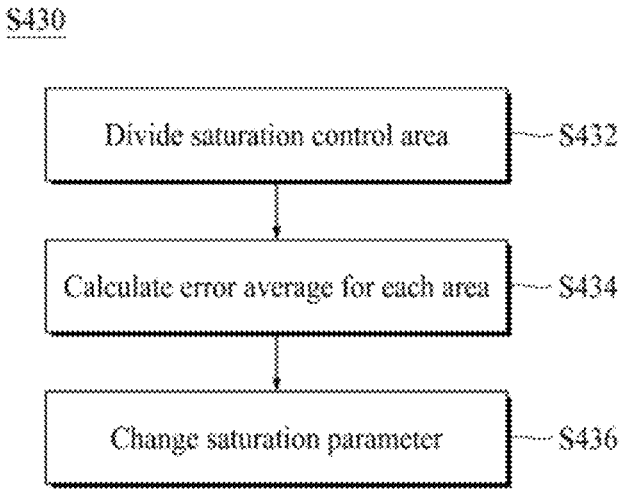
FIG. 8 is a flowchart illustrating a saturation control area division and saturation parameter changing operation according to an embodiment.

Referring to FIGS. 5 and 8, the saturation control area division and saturation parameter changing operation S430 may include a saturation control area division operation S432, an error average calculation operation S434 for each area, and a saturation parameter changing operation S436.

In the saturation control area division operation S432, the automatic tuning part 200 may calculate a saturation value Saturation_input of the 48 color points from the Cb and Cr data of the 48 color points and determine a saturation control area in which the saturation value Saturation_input of each of the 48 color points is located by comparing the calculated saturation value Saturation_input of the 48 color points with the calculated first and second saturation boundary values Sat_low_point and Sat_mid_point.

For example, the automatic tuning part 200 may calculate the saturation value Saturation_input corresponding to a distance from the origin to the corresponding Cb and Cr points on the Cb-Cr plane illustrated in FIGS. 2 and 3 by using the Cb and Cr data of each of the 48 color points.

The automatic tuning part 200 may compare the calculated saturation value Saturation_input of each of the 48 color points with the first and second saturation boundary values Sat_low_point and Sat_mid_point and may divide and determine a saturation control area in which the saturation value of each of the 48 color points is located.

For example, the automatic tuning part 200 may determine that the saturation value Saturation_input, which is smaller than the first saturation boundary value Sat_low_point is located in the first saturation control area 52L, determine that the saturation value Saturation_input which is greater than the first saturation boundary value Sat_low_point and smaller than the second saturation boundary value Sat_mid_point is located in the second saturation control area 52M, and determine that the saturation value Saturation_input which is greater than the second saturation boundary value Sat_mid_point is located in the third saturation control area 52H.

In the error average calculation operation S434 for each area, the automatic tuning part 200 may calculate an error average of reference distances between uv reference values and an intermediate point gray_point and measurement distances between the uv measurement values and the intermediate point gray_point for each saturation control area and determine a direction of change of the saturation parameter according to the calculated error average for each saturation control area.

For example, the automatic tuning part 200 may calculate a reference distance $ref_{distance}$ between the reference uv coordinates ($ref_x$, $ref_y$) and the intermediate point gray_point coordinates ($gray_x$, $gray_y$) and a measurement distance $meas_{distance}$ between the measurement uv coordinates ($meas_x$, $meas_y$) and the intermediate point gray_point coordinates ($gray_x$, $gray_y$) and calculate a distance difference $diff_{distance}$ between the calculated reference distance $ref_{distance}$ and the measurement distance $meas_{distance}$, that is, an error distance, for each saturation control area as shown in Equation 3 below.

$$ref_{distance} = \sqrt{(ref_y - gray_y)^2 + (ref_x - gray_x)^2} \quad \text{[Equation 3]}$$

$$diff_{distance} = meas_{distance} - ref_{distance}$$

$$meas_{distance} = \sqrt{(meas_y - gray_y)^2 + (meas_x - gray_x)^2}$$

The automatic tuning part 200 may calculate an average of the distance difference $diff_{distance}$ between the calculated reference distance $ref_{distance}$ and the measurement distance $meas_{distance}$ for each saturation control area as the error average for each saturation control area, and may determine the direction of change of the saturation parameters, that is, a decreasing direction or an increasing direction, according to the calculated error average.

In the saturation parameter changing operation S436, the automatic tuning part 200 may change an input saturation parameter $Sgain_{input}$ by applying a step-by-step change value $Sgain_{step}$ according to the change (decreasing or increasing) direction of the saturation parameter determined for each saturation control area in the operation S434.

The automatic tuning part 200 may select the step-by-step change value $Sgain_{step}$ that increases or decreases according to the change (decreasing or increasing) direction of the saturation parameter determined for each saturation control area and may change the step-by-step change value $Sgain_{step}$ to an output saturation parameter ($Sgain_{output}$=$Sgain_{input}$+$Sgain_{step}$) by adding the selected step-by-step change value $Sgain_{step}$ to the input saturation parameter $Sgain_{input}$. The automatic tuning part 200 may change 46 saturation parameters assigned to each of the twelve hue axes Ax0 to Ax11 for each saturation control area.

Figure 9:
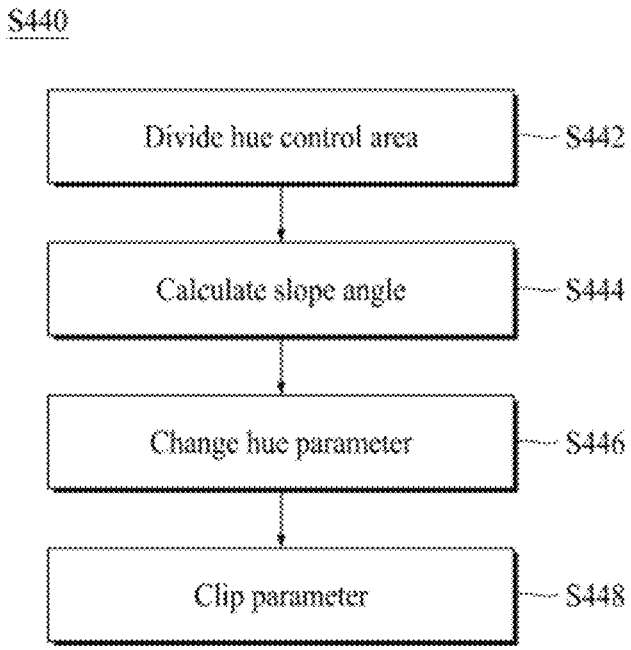
FIG. 9 is a flowchart illustrating a hue control area division and hue parameter changing operation according to an embodiment.

Referring to FIGS. 5 and 9, the hue control area division and hue parameter changing operation S440 may include a hue control area division operation S442, a slope angle calculation operation S444, and a hue parameter changing operation S446 and further include a parameter clipping operation S448.

In the hue control area division operation S442, the automatic tuning part 200 may compare the calculated saturation value Saturation_input of each of the 48 color points with the third saturation boundary value Hue_point, and may divide and determine a hue control area in which the saturation value of each of the 48 color points is located.

The automatic tuning part 200 may determine that the saturation value Saturation_input which is smaller than the third saturation boundary value Hue_point is located in the first hue control area 54L and determine that the saturation value Saturation_input which is greater than the third saturation boundary value Hue_point is located in the second hue control area 54H.

In the slope angle calculation operation S444, the automatic tuning part 200 may calculate a reference slope of a straight line connecting each uv reference value to the white point and a measurement slope of a straight line connecting each uv measurement value and the white point for each hue control area, calculate angles of the calculated reference slope and the calculated measurement slope, and determine a direction of change of the hue parameter according to a difference between the calculated reference angle and the calculated measurement angle.

For example, the automatic tuning part 200 may calculate a reference slope $ref_slope_{axis}$ of a straight line connecting the reference uv coordinates ($ref_x$, $ref_y$) to white point coordinates ($white_x$, $white_y$) and a measurement slope $meas_slope_{axis}$ of a straight line connecting the measurement uv coordinates ($meas_x$, $meas_y$) to the white point coordinates ($white_x$, $white_y$), for each saturation control area as shown in Equation 4.

$$ref_slope_{axis}=(ref_y-white_y)/(ref_x-white_x)$$

$$meas_slope_{axis}=(meas_y-white_y)/(meas_x-white_x) \quad \text{[Equation 4]}$$

The automatic tuning part 200 may calculate a reference angle of the uv reference value and the measurement angle of the uv measurement value by applying an arctangent function to each of the reference slope $ref_slope_{axis}$ and the measurement slope $meas_slope_{axis}$ which are calculated for each saturation control area, and may calculate an angle difference between the calculated reference angle of the uv reference value and the measurement angle of the uv measurement value. The automatic tuning part 200 may determine the direction of change of the hue parameters, that is, the decreasing direction or the increasing direction, according to the angle difference calculated for each hue area.

In the hue parameter changing operation S446, the automatic tuning part 200 may change an input hue parameter $Hgain_{input}$ by applying a step-by-step change value $Hgain_{step}$ according to the change (decreasing or increasing) direction of the hue parameter determined for each hue control area in the operation S444.

The automatic tuning part 200 may select the step-by-step change value $Hgain_{step}$ according to the decreasing or increasing direction of the hue parameters determined for each hue control area and change the step-by-step change value $Hgain_{step}$ to an output hue parameter ($Hgain_{output}=Hgain_{input}+Hgain_{step}$) by adding the selected step-by-step change value $Hgain_{step}$ to the input hue parameter $Hgain_{input}$. Each of the input hue parameter $Hgain_{input}$, the step-by-step change value $Hgain_{step}$, and the output hue parameter $Hgain_{output}$ represents an angle.

The automatic tuning part 200 may change 24 hue parameters which are assigned to each of the twelve hue axes Ax0 to Ax11 for each hue control area.

In the parameter clipping operation S448, the automatic tuning part 200 may output the parameters by limiting each parameter to be within an expression range (0 to 255) before outputting the changed saturation parameters and the changed hue parameters.

The test device 100 transmits the saturation parameters for each saturation control area of each hue axis and the hue parameters for each hue control area of each hue axis, which are changed by the automatic tuning part 200, to the display device 300 to update the register of the color gamut mapping device 600.

The test device 100 may repeat the operation S20 of measuring the uv coordinates of each color image displayed through the display device 300 in which the register of the color gamut mapping device 600 is updated, the operation S30 of transmitting the uv measurement values and the changed parameters, the operation S40 of performing the automatic tuning on the basis of the uv measurement values, and the operation S50 of updating the register by transmitting the parameters changed through the automatic tuning to the color gamut mapping device 600, and the test device 100 may repeat the above-described tuning process until the error value between the uv reference value and the uv measurement value is less than or equal to the threshold value in the automatic tuning operation S40.

As described above, in the tuning method and apparatus for the color gamut mapping device according to the embodiment, the uv coordinates for each color output through the corresponding display device may be measured, and when the error value between the uv measurement value and the uv reference value exceeds the threshold value, the saturation parameters assigned to each saturation control area may be automatically changed step by step on the basis of the distance error between the uv reference value and the uv measurement value and the hue parameters may be automatically changed step by step for each hue control area on the basis of the angle difference between the uv reference value and the uv measurement value. Therefore, it is possible to shorten a tuning time in which the saturation parameters, which are assigned to each saturation control area of each hue axis, and the hue parameters, which are assigned to each hue control area of each hue axis, are changed according to the target color gamut and it is possible to improve tuning accuracy.

Figure 10A:
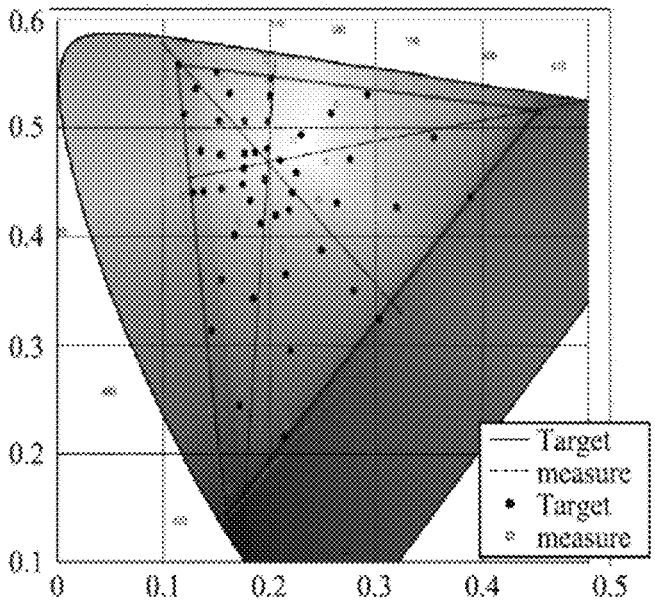
FIGS. 10A and 10B are comparison diagrams illustrating a tuning result of a color gamut mapping device according to an embodiment and a result before tuning of the color gamut mapping device.
Figure 10B:
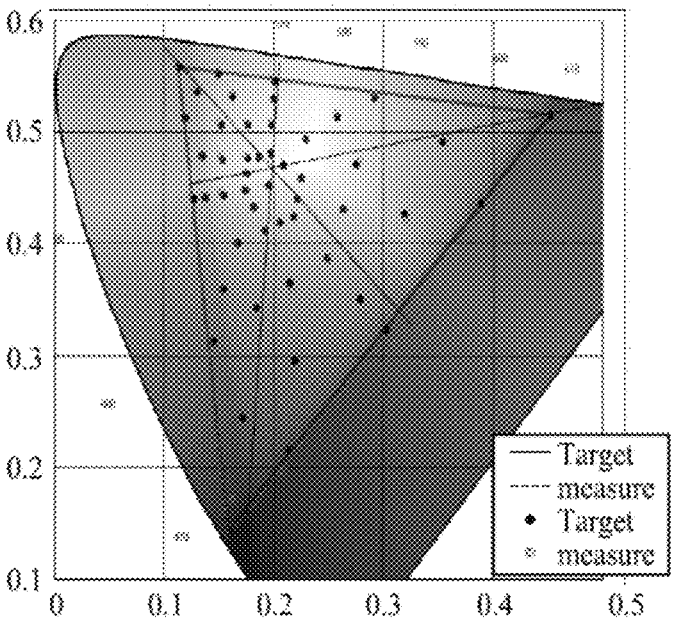
Figure 11A:
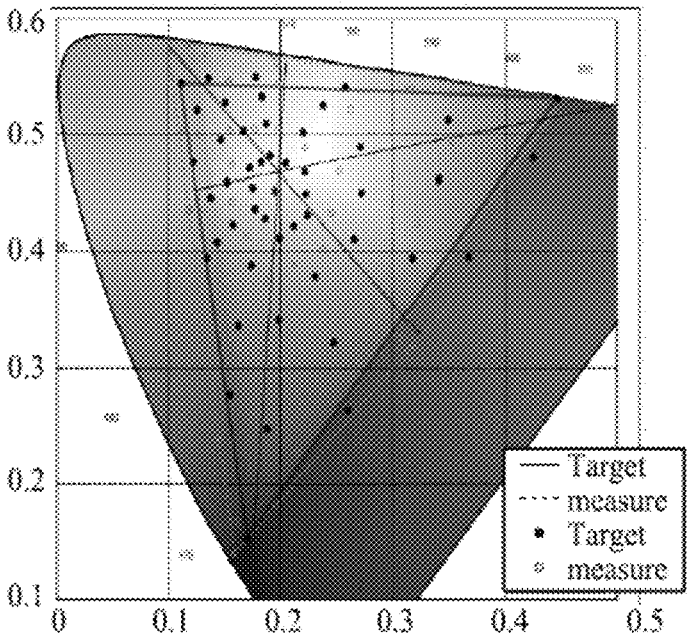
FIGS. 11A and 11B are comparison diagrams illustrating a tuning result of a color gamut mapping device according to an embodiment and a result before tuning of the color gamut mapping device.
Figure 11B:
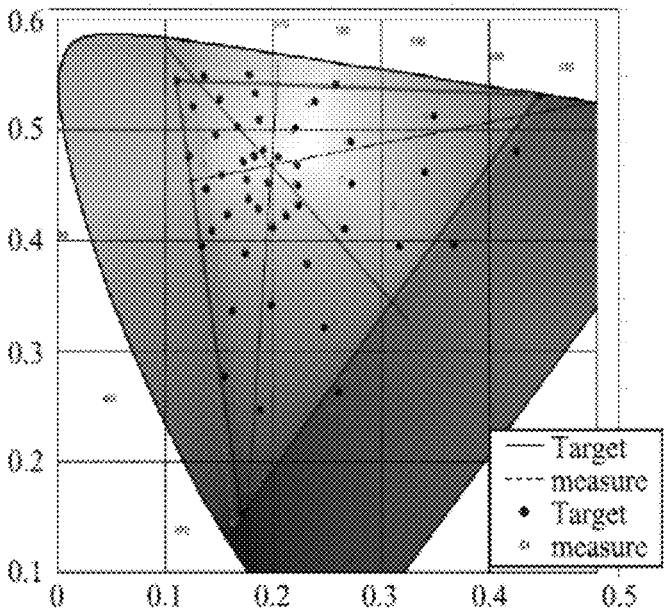

FIGS. 10A and 10B are comparison diagrams illustrating a tuning result of a color gamut mapping device according to an embodiment and a result before tuning of the color gamut mapping device. FIGS. 11A and 11B are comparison diagrams illustrating a tuning result of a color gamut mapping device according to an embodiment and a result before tuning of the color gamut mapping device.

Referring to FIGS. 10A and 11A, it can be seen that an output color gamut of a corresponding display device in which the color gamut mapping device is turned off is greater than a target color gamut, measurement uv coordinates of the display device do not match target uv coordinates, and the measurement uv coordinates have a large chrominance between the target uv coordinates, and thus an error range of color gamut mapping may be increased. As a result, color reproducibility may be lowered and image quality may be lowered.

On the other hand, referring to FIGS. 10B and 11B, as a result of turning on the color gamut mapping device according to the embodiment and tuning according to the target color gamut of the corresponding display device, it can be seen that an output color gamut of an image output to the corresponding display through the tuned color gamut mapping device is mapped to match the target color gamut and the measurement uv coordinates of the corresponding display device match or are similar to the target uv coordinates, and thus chrominance between the measurement uv coordinates and the target uv coordinates may be reduced so that an error range of color gamut mapping may be reduced. As a result, color reproducibility can be improved and image quality can be improved.

The color gamut mapping device and the display device including the same according to the embodiment may be applied to various electronic devices. For example, the color gamut mapping device and the display device including the same according to the embodiment may be applied to a mobile device, a video phone, a smart watch, a watch phone, a wearable device, a foldable device, a rollable device, a bendable device, a flexible device, a curved device, an electronic notebook, an e-book, a portable multimedia player (PMP), a personal digital assistant (PDA), an MPEG audio layer-3 player, a mobile medical device, a desktop personal computer (PC), a laptop PC, a netbook computer, a workstation, a navigation device, a vehicle navigation device, a vehicle display device, a television, a wallpaper display device, a signage device, a game device, a notebook computer, a monitor, a camera, a camcorder, a home appliance, and the like.

The color gamut mapping device according to the embodiment may be implemented in the form of an IC. A function of the color gamut mapping device according to the embodiment may be implemented in the form of a program and mounted in an IC. The function of the color gamut mapping device according to the embodiment may be implemented as a program, functions of the components included in the color gamut mapping device may be implemented as a specific code, and code for implementing a specific function may be implemented as one program or may be implemented by being divided into a plurality of programs.

Features, structures, effects, etc. described above in various examples of the present disclosure are included in at least one example of the present disclosure and are not necessarily limited to only one example. Furthermore, features, structures, effects, etc. illustrated in at least one example of the present disclosure may be combined or modified for other examples by those skilled in the art to which the technical idea of the present disclosure pertains. Therefore, the contents related to such combinations and modifications should be interpreted as being included in the technical spirit or scope of the present disclosure.

While the present disclosure described above is not limited to the above-described embodiments and the accompanying drawings, it will be apparent to those skilled in the art to which the present disclosure belongs that various substitutions, modifications, and changes may be made herein without departing from the scope of the present disclosure. Therefore, the scope of the present disclosure is defined by the appended claims, and all changes or modifications derived from the meaning, scope, and equivalence of the claims are to be construed as being included in the scope of the present disclosure.

What is claimed is:

1. A tuning method of a color gamut mapping device, the tuning method comprising:

an initial setting operation of setting, by a test device, initial parameters in a register of a color gamut mapping device;

a measuring operation of measuring, by a measuring device, chromaticity for each of a plurality of color images which are supplied from the test device and displayed on a panel of a display device through the color gamut mapping device;

an automatic tuning operation of changing, by the test device, saturation parameters and hue parameters of a plurality of hue axes of the color gamut mapping device by using a result measured from the measuring device and the initial parameters on the basis of a difference between a uv measurement value of each of the plurality of color images and a uv reference value of each of the plurality of color images; and an updating operation of transmitting, by the test device, the changed saturation parameters and hue parameters of the respective hue axes to the color gamut mapping device and updating the register.

2. The tuning method of claim 1, wherein, in the automatic tuning operation, the test device repeats the measuring operation, the automatic tuning operation, and the updating operation of the register until a representative error value using an error between the uv reference value and the uv measurement value is less than or equal to a threshold value.

3. The tuning method of claim 1, wherein:

in the initial setting operation, the test device further sets the plurality of uv reference values corresponding to target color points of the plurality of color images; and the test device sets the saturation parameters for each of a plurality of saturation control areas of each hue axis and sets the hue parameters for each of a plurality of hue control areas of each hue axis.

4. The tuning method of claim 2, wherein the automatic tuning operation includes:

when the representative error value is less than or equal to the threshold value, completing, by the test device, the automatic tuning;

when the representative error value exceeds the threshold value, performing default setting for performing the automatic tuning;

dividing a plurality of saturation control areas on the basis of the plurality of uv measurement values and the plurality of uv reference values and changing the saturation parameters for each saturation control area; and dividing a plurality of hue control areas on the basis of the plurality of uv measurement values and the plurality of uv reference values and changing the hue parameters for each hue control area.

5. The tuning method of claim 4, wherein the performing of the default setting includes:

determining, by the test device, three-color data of each of a plurality of color points on the basis of the plurality of uv measurement values and performing degamma thereon;

converting the three-color data of each color point on which the degamma is performed into a luminance component and a pair of chrominance components; and calculating a first saturation boundary value that distinguishes a first saturation control area and a second saturation control area using a first saturation control point, a second saturation control point, and a maximum saturation value which are set in the initial setting operation, a second saturation boundary value that distinguishes the second saturation control area and a third saturation control area, and a third saturation boundary value that distinguishes a first hue control area and a second hue control area using a hue control point and the maximum saturation value.

6. The tuning method of claim 5, wherein the changing of the saturation parameters includes:

determining, by the test device, a saturation control area in which each color point is located by comparing a saturation value using the chrominance components of each color point with the first and second saturation boundary values;

determining a direction of change of the saturation parameters for each determined saturation control area on the basis of a distance difference between a reference distance component using the uv reference value and a measurement distance component using the uv measurement value; and changing the saturation parameters step by step by applying a step-by-step change value according to the determined direction of change to the saturation parameters.

7. The tuning method of claim 6, wherein:

the determining of the direction of change of the saturation parameters includes:

calculating, by the test device, reference distances between the respective uv reference values and an intermediate point and measurement distances between the respective uv measurement values and the intermediate point, calculating distance differences between the calculated reference distances and the calculated measurement distances and averaging the distance differences for each saturation control area to calculate as an error average, and determining the direction of change of the saturation parameter as a decreasing direction or an increasing direction according to the error average calculated for each saturation control area; and the changing of the saturation parameters step by step includes adding, by the test device, the step-by-step change value according to the determined decreasing or increasing direction of the saturation parameter to the respective saturation parameters.

8. The tuning method of claim 5, wherein the changing of the hue parameter includes:

determining, by the test device, a hue control area in which each color point is located by comparing a saturation value using the chrominance components of each color point with the third saturation boundary value;

determining a direction of change of the hue parameters for each determined hue control area on the basis of an angle difference between a reference angle of the uv reference value and a measurement angle of the uv measurement value; and changing the hue parameters by applying a step-by-step change value according to the determined direction of change.

9. The tuning method of claim 8, wherein:

the determining of the direction of change of the hue parameters includes:

calculating, by the test device, an angle difference between the reference angle with respect to a slope of a straight line connecting the uv reference value to a white point and the measurement angle with respect to a slope of a straight line connecting the uv measurement value to the white point, and determining the direction of change of the hue parameters as a decreasing direction or an increasing direction according to the angle difference calculated for each hue control area; and the changing of each hue parameter includes adding, by the test device, the step-by-step change value according to the determined decreasing or increasing direction of the hue parameter to the respective hue parameters.

10. A tuning apparatus for the color gamut mapping device, the tuning apparatus comprising:

a test device;

a display device configured to display a plurality of color images which are supplied from the test device through the color gamut mapping device on a panel; and a measuring device configured to measure chromaticity for each of the plurality of color images displayed on the panel, wherein the test device is configured to:

set initial parameters in a register of the color gamut mapping device, perform an automatic tuning process in which saturation parameters set for each of a plurality of saturation control areas to correspond to a plurality of hue axes and hue parameters set for each of a plurality of hue control areas to correspond to the respective hue axes are changed based on differences between uv measurement values of the plurality of color images supplied from the measuring device and uv reference values set to correspond to target color points of the plurality of color images, and transmit the changed saturation parameters and hue parameters for each hue axis to the color gamut mapping device to update the register.

11. The tuning apparatus of claim 10, wherein the test device repeats the measuring process of supplying the plurality of color images to the display device and receiving the uv measurement values of the plurality of color images displayed on the panel from the measuring device, the automatic tuning process of changing the saturation parameters and the hue parameters, and the process of updating the register, until a representative error value using errors between the uv reference values and the uv measurement values is less than or equal to a threshold value.

12. The tuning apparatus of claim 11, wherein the test device is configured to:

when the representative error value is less than or equal to a threshold value, complete the automatic tuning process;

when the representative error value exceeds the threshold value, perform default setting for performing the automatic tuning;

divide a plurality of saturation control areas on the basis of the plurality of uv measurement values and the plurality of uv reference values and changing the saturation parameters for each saturation control area; and divide a plurality of hue control areas on the basis of the plurality of uv measurement values and the plurality of uv reference values and changing the hue parameters for each hue control area.

13. The tuning apparatus of claim 12, wherein the test device is configured to:

determine three-color data of each of a plurality of color points on the basis of the plurality of uv measurement values to perform degamma thereon;

convert the three-color data of each color point on which the degamma is performed into a luminance component and a pair of chrominance components; and calculate a first saturation boundary value that distinguishes a first saturation control area and a second saturation control area using first and second saturation control points and a maximum saturation value which are preset, a second saturation boundary value that distinguishes the second saturation control area and a third saturation control area, and a third saturation boundary value that distinguishes the first saturation control area and the second hue control area using a hue control point and the maximum saturation value.

14. The tuning apparatus of claim 13, wherein the test device is configured to:

determine a saturation control area in which each color point is located by comparing a saturation value using the chrominance components of each color point with the first and second saturation boundary values;

determine a direction of change of the saturation parameters for each determined saturation control area on the basis of a distance difference between a reference distance component using the uv reference value and a measurement distance component using the uv measurement value; and change the saturation parameters step by step by applying a step-by-step change value according to the determined direction of change to each saturation parameters.

15. The tuning apparatus of claim 14, wherein the test device is configured to:

calculate reference distances between the respective uv reference values and an intermediate point and measurement distances between the respective uv measurement values and the intermediate point;

calculate distance differences between the calculated reference distances and the calculated measurement distances and average the distance differences for each saturation control area to calculate as an error average;

determine the direction of change of the saturation parameter as a decreasing direction or an increasing direction according to the error average calculated for each saturation control area; and add the step-by-step change value according to the determined decreasing or increasing direction of the saturation parameter to the respective saturation parameters.

16. The tuning apparatus of claim 13, wherein the test device is configured to:

determine a hue control area in which each color point is located by comparing a saturation value using the chrominance components of each color point with the third saturation boundary value;

determine a direction of change of the hue parameters for each determined hue control area on the basis of an angle difference between a reference angle of the uv reference value and a measurement angle of the uv measurement value; and change the hue parameters by applying a step-by-step change value according to the determined direction of change.

17. The tuning apparatus of claim 16, wherein the test device is configured to:

calculate an angle difference between the reference angle with respect to a slope of a straight line connecting the uv reference value to a white point and the measurement angle with respect to a slope of a straight line connecting the uv measurement value to the white point;

determine the direction of change of the hue parameters as a decreasing direction or an increasing direction according to the angle difference calculated for each hue control area; and add the step-by-step change value according to the determined decreasing or increasing direction of the hue parameter to the respective hue parameters.

* * * * *